US005914030A

United States Patent [19]

Bearden et al.

[11] Patent Number: 5,914,030

[45] Date of Patent: Jun. 22, 1999

[54] PROCESS FOR REDUCING TOTAL ACID NUMBER OF CRUDE OIL

[75] Inventors: Roby Bearden, Baton Rouge, La.; Saul Charles Blum, Edison; William Neergaard Olmstead, Murray Hill, both of N.J.

[73] Assignee: Exxon Research and Engineering. Co., Florham Park, N.J.

[21] Appl. No.: 09/072,764

[22] Filed: May 5, 1998

Related U.S. Application Data

[63] Continuation-in-part of application No. 08/920,447, Aug. 29, 1997, abandoned.

[51] Int. Cl.[6] ..... C10G 17/00

[52] U.S. Cl. ..... 208/263; 208/264; 208/189

[58] Field of Search ..... 208/263, 264, 208/189

[56] References Cited

U.S. PATENT DOCUMENTS

| | | | |
|---|---|---|---|
| 1,953,353 | 4/1934 | Lazar et al. | 196/1 |
| 2,040,098 | 5/1936 | Miller | 260/627 |
| 2,040,104 | 5/1936 | Radasch | 260/154 |
| 2,068,979 | 1/1937 | Fisher | 196/35 |
| 2,227,811 | 1/1941 | Moser | 196/36 |
| 2,770,580 | 11/1956 | Honeycutt | 196/36 |
| 2,795,532 | 6/1957 | Honeycutt | 196/36 |
| 2,921,023 | 1/1960 | Holm | 208/263 |
| 2,966,456 | 12/1960 | Honeycutt | 208/263 |
| 3,617,501 | 11/1971 | Eng et al. | 208/89 |
| 3,850,744 | 11/1974 | Plundo et al. | 208/210 |
| 3,876,532 | 4/1975 | Plundo et al. | 208/216 |
| 4,033,860 | 7/1977 | Carlson | 208/206 |
| 4,134,825 | 1/1979 | Bearden, Jr. et al. | 208/108 |
| 4,199,440 | 4/1980 | Verachtert | 208/230 |
| 4,637,870 | 1/1987 | Bearden, Jr. et al. | 208/112 |
| 5,039,392 | 8/1991 | Bearden, Jr. et al. | 208/112 |
| 5,250,175 | 10/1993 | Des Ormeaux | 208/356 |
| 5,620,591 | 4/1997 | Poole et al. | 208/112 |

FOREIGN PATENT DOCUMENTS

| | | | |
|---|---|---|---|
| WO 9606899 | 3/1996 | WIPO | C10G 45/50 |

OTHER PUBLICATIONS

"Refining With Alkalies", Petroleum Refining With Chemicals, Kalichevsky, Elsevier, 1956, Chapter 4, pp. 136–180.

"Neutralization as a Means of Controlling Corrosion of Refinery Equipment", E.Q. Camp and Cecil Phillips, presented at the Fifth Annual Conference, National Association of Corrosion Engineers, Apr. 11–14, NACE, vol. 6, pp. 39–46, Feb. 1950.

*Primary Examiner*—Helane Myers
*Attorney, Agent, or Firm*—E. C. Bakun

[57] ABSTRACT

The invention comprises a method for reducing the amount of carboxylic acids in petroleum feeds comprising the steps of (a) adding to said petroleum feed a catalytic agent comprising an oil soluble or oil dispersible compound of a metal selected from the group consisting of Group VB, VIB, VIIB and VIII metals, wherein the amount of metal in said petroleum feed is at least about 5 wppm, (b) heating said petroleum feed with said catalytic agent in a reactor at a temperature of about 400 to about 800° F. (about 204.44 to about 426.67° C.), under a hydrogen pressure of 15 psig to 1000 psig (204.75 to 6996.33 kPa), and (c) sweeping the reactor containing said petroleum feed and said catalytic agent with hydrogen-containing gas at a rate sufficient to maintain the combined water and carbon dioxide partial pressure below about 50 psia (about 344.75 kPa).

20 Claims, 1 Drawing Sheet

FIG. 1: WATER PRESSURE VS SWEEP RATE
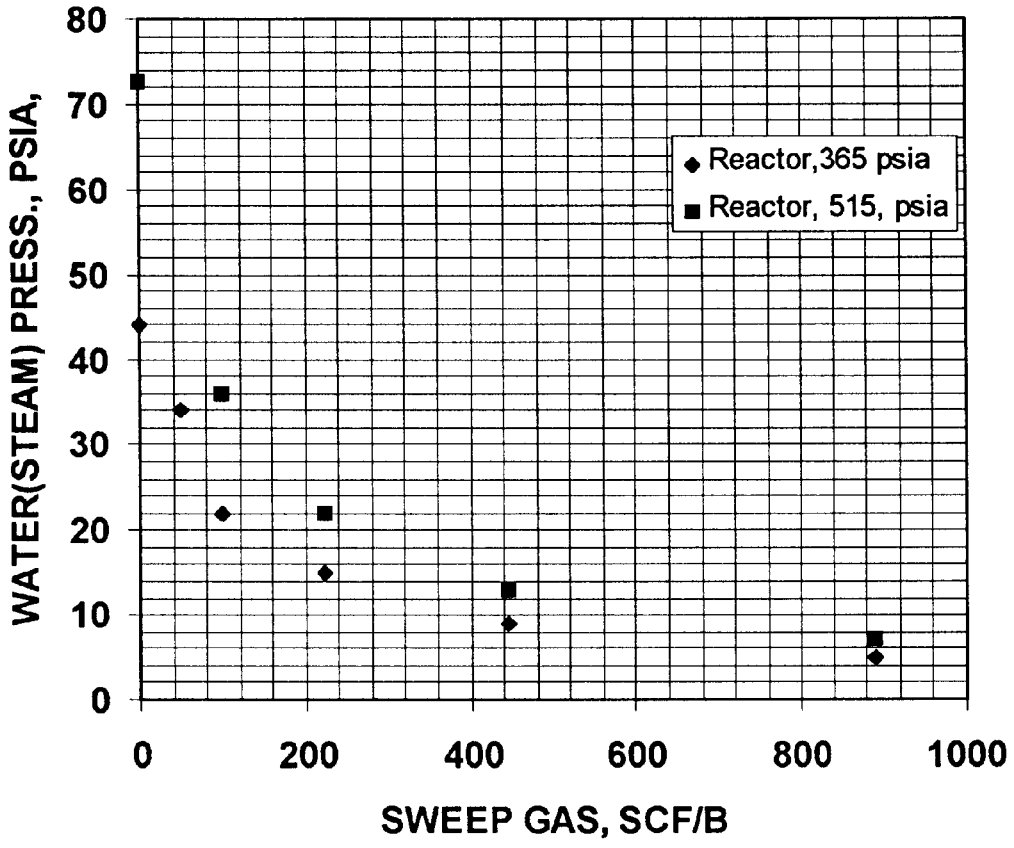

PROCESS FOR REDUCING TOTAL ACID NUMBER OF CRUDE OIL

CROSS-REFERENCE TO RELATED APPLICATION

This application is a Continuation-In-Part of U.S. Ser. No. 920,447 filed Aug. 29, 1997, now abandoned.

FIELD OF THE INVENTION

The present invention is directed to a method for reducing the Total Acid Number (TAN) of crude oils, a number that is based on the amount of carboxylic acids, especially naphthenic acids, that are present in the oil.

BACKGROUND OF THE INVENTION

The presence of relatively high levels of petroleum acids, e.g., naphthenic acids, in crude oils or fractions thereof is a problem for petroleum refiners and more recently for producers as well. Essentially, these acids, which are found to a greater or lesser extent in virtually all crude oils, are corrosive, tend to cause equipment failures, and lead to high maintenance costs, more frequent turnarounds than would otherwise be necessary, reduce product quality, and cause environmental disposal problems.

A very significant amount of literature, both patents and publications, exists that deal with naphthenic acid removal by conversion or absorption. For example, many aqueous materials can be added to crudes or crude fractions to convert the naphthenic acids to some other material, e.g., salts, that can either be removed or are less corrosive. Other methods for naphthenic acid removal are also well known including absorption, on zeolites, for example. Additionally, one common practice for overcoming naphthenic acid problems is the use of expensive corrosion resistant alloys in refinery or producer equipment that will encounter relatively high naphthenic acid concentrations. Another common practice involves blending of crudes with high TAN with crudes of lower TAN, the latter, however being significantly more costly than the former. One reference, Lazar, et al. (U.S. Pat. No. 1,953,353) teaches naphthenic acid decomposition of topped crudes or distillates, effected at atmospheric pressure between 600 and 750° F. (315.6 to 398.9° C.). However, it only recognizes $CO_2$ as the sole gaseous non-hydrocarbon, naphthenic acid decomposition product and makes no provision for avoiding buildup of reaction inhibitors.

Additionally, U.S. Pat. No. 2,921,023 describes removal of naphthenic acids from heavy petroleum fractions by hydrogenation with a molybdenum oxide-on-silica/alumina catalyst. More specifically, the process preferentially hydrogenates oxo-compounds and/or olefinic compounds, for example, naphthenic acids, in the presence of sulfur compounds contained in organic mixtures without affecting the sulfur compounds. This is accomplished by subjecting the organic mixture to the action of hydrogen at temperatures between about 450 and 600° F. (232.2 to 315.6° C.), in the presence of a molybdenum oxide containing catalyst having a reversible water content of less than about 1.0 wt %. Catalyst life is prolonged by regeneration.

WO 96/06899 describes a process for removing essentially naphthenic acids from a hydrocarbon oil. The process includes hydrogenation at 1 to 50 bar (100 to 5000 kPa) and at 100 to 300° C. (212 to 572° F.) of a crude that has not been previously distilled or from which a naphtha fraction has been distilled using a catalyst consisting of Ni—Mo or Co—Mo on an alumina carrier. The specification describes the pumping of hydrogen into the reaction zone. No mention is made of controlling water and carbon dioxide partial pressure.

U.S. Pat. No. 3,617,501 describes an integrated process for refining whole crude but does not discuss TAN reduction. The first step of the process includes hydrotreating a feed, which can be a whole crude oil fraction, using a catalyst comprising one or more metals supported on a carrier material. Preferably the metals are metal oxides or sulfides, such as molybdenum, tungsten, cobalt, nickel and iron supported on a suitable carrier material such as alumina or alumina that contains a small amount of silica. The catalyst can be employed in the form of fixed bed, a slurry or fluidized bed reactor. With regard to sluwiy operation, no mention is made of catalyst particle size, catalyst concentration in feed or the use of unsupported catalysts (i.e., no carrier).

British Patent 1,236,230 describes a process for the removal of naphthenic acids from petroleum distillate fractions by processing over supported hydrotreating catalysts without the addition of gaseous hydrogen. No mention is made of controlling water and carbon dioxide partial pressure.

U.S. Pat. Nos. 4,134,825; 4,740,295; 5,039,392; and 5,620,591, all of which are incorporated herein by reference, teach the preparation of highly dispersed, unsupported catalysts, of nominal particle size of one micron, from oil soluble or oil dispersible compounds of metals selected from groups IVB, VB, VIB, VIIB and VIII of the periodic table of elements and application of said catalysts for the hydroconversion upgrading of heavy feeds, including whole or topped petroleum crudes. Hydroconversion is defined in these patents as a catalytic process conducted in the presence of hydrogen wherein at least a portion of the heavy constituents and coke precursors (i.e., Comnadson Carbon) are converted to lower boiling compounds. The broadest ranges cited in these references with respect to process conditions include temperatures in the range of 644–896° F. (339.9 to 480° C.), hydrogen paltial pressures ranging from 50–5000 psig (446.08 to 34516.33 kPa) and from 10–2000 wppm of catalyst metal based on the weight of the feedstock. These references are directed to the conversion upgrading of heavy feeds and do not recognize that said catalysts can be used to selectively destroy carboxylic acids, e.g., naphthenic acids.

Another method for removal of such acids includes treatment at temperatures of at least about 400° F. (204.44° C.), preferably at least about 600° F. (315.56° C.) while sweeping the reaction zone with an inert gas to remove inhibitors indigenous to or formed during the treatment. However, this approach is debited by the volatilization of some of the naphthenic acids, which are found in distillate and light oil fractions that flash during the thermal treatment. Moreover, treatment temperatures may be too high for this method to be used in downstream applications where it is desirable to destroy the acids prior to pipestill furnaces, i.e., at temperatures of about 550° F. (287.78° C.) or below.

Thus, there remains a need for eliminating or at least substantially reducing petroleum acid concentration in crudes or fractions thereof that is low cost and refinery friendly. Such technology would be particularly suitable for crudes or fractions where the TAN is about 2 mg KOH/gm oil or above as determined by ASTM method D-664.

SUMMARY OF THE INVENTION

The instant invention is directed to a method for destroying carboxylic acids in whole crudes and crude fractions.

The invention comprises a method for reducing the amount of carboxylic acids in petroleum feeds comprising the steps of (a) adding to said petroleum feed a catalytic agent comprising an oil soluble or oil dispersible compound of a metal selected from the group consisting of Group VB, VIB, VIIB and VIII metals, wherein the amount of metal in said petroleum feed is at least about 5 wppm, (b) heating said petroleum feed with said catalytic agent in a reactor at a temperature of about 400 to about 800° F. (about 204.44 to about 426.67° C.), under a hydrogen pressure of 15 psig to 1000 psig (204.75 to 6996.33 kPa) and (c) sweeping the reactor containing said petroleum feed and said catalytic agent with hydrogen-containing gas at a rate sufficient to maintain the combined water and carbon dioxide partial pressure below about 50 psia (about 344.75 kPa).

TAN is defined as the weight in milligrams of potassium hydroxide required to neutralize all acidic constituents in one gram of oil. (See ASTM method D-664.)

Vacuum bottoms conversion is defined as the conversion of material boiling above 1025° F. (551.67° C.) to material boiling below 1025° F. (551.67° C.).

BRIEF DESCRIPTION OF THE FIGURES

FIG. 1 is the calculated partial pressure for water as a function of reactor pressure and rate of hydrogen-containing gas sweep for the process of the instant invention.

DETAILED DESCRIPTION OF THE INVENTION

The instant invention removes or destroys carboxylic acids (e.g., naphthenic acids) contained in petroleum feeds such as whole crude oils (including heavy crudes) and fractions thereof such as vacuum gas oil fractions, topped crudes, vacuum resids, atmospheric resids, topped crudes and vacuum gas oil. The instant method reduces TAN by at least about 40% in the petroleum feed.

The process is run at temperatures from about 400 to about 800° F. (about 204.44 to about 426.67° C.), more preferably about 450 to about 750° F. (about 232.22 to about 398.89° C.), and most preferably about 500 to about 650° F. (about 260.00 to about 343.33° C.). Hydrogen pressures range from about atmospheric to about 2000 psig (atmospheric to about 13891.33 kPa), preferably about 15 psig to about 1000 psig (about 204.75 to about 6996.33 kPa), and most preferably about 50 psig to about 500 psig (about 446.08 to about 3548.83 kPa). The amount of catalyst, calculated as catalyst metal or metals, used in the process ranges from at least about 5, preferably about 10 to about 1000 parts per million weight (wppm) and most preferably about 20 to 500 wppm of the petroleum feed being treated.

Preferably, during the process of the instant invention, less than about 40% of the vacuum bottoms component of the feed, i.e., the fraction boiling above about 1025° F. (551.67° C.), is converted to material boiling below about 1025° F. (551.67° C.) and, more preferably, less than about 30% vacuum bottoms conversion occurs.

Catalyst particle size ranges from about 0.5 to about 10 microns, preferably about 0.5 to 5 microns, and most preferably about 0.5 to 2.0 microns. Catalysts are prepared from precursors, also refelTed to herein as catalytic agents, such as oil soluble or oil dispersible compounds of Group VB, VIB, VIIB, or VIII metals and mixtures thereof Suitable catalyst metals and metal compounds are disclosed in U.S. Pat. No. 4,134,825 herein incorporated by reference. An example of an oil soluble compound is the metal salt of a naphthenic acid such as molybdenum naphthenate. Examples of oil dispersible compounds are phosphomolybdic acid and ammonium heptamolybdate, materials that are first dissolved in water and then dispersed in the oil as a water-in-oil mixture, wherein droplet size of the water phase is below about 10 microns.

Ideally, a catalyst precursor concentrate is first prepared wherein the oil-soluble or oil-dispersible metal compound(s) is blended with a portion of the process feed to form a concentrate that contains at least about 0.2 wt % of catalyst metal, preferably about 0.2 to 2.0 wt % catalyst metal. See for example U.S. Pat. No. 5,039,392 or 4,740,295 herein incorporated by reference. The resultant precursor concentrate can be used directly in the process or first converted to a metal sulfide concentrate or an activated catalyst concentrate prior to use.

Catalyst precursor concentrate can be converted to a metal sulfide concentrate by treating with elemental sulfur (added to the portion of feed used to prepare the concentrate) or with hydrogen sulfide at 300 to 400° F. (148.89 to 204.44° C.) for10–15 minutes (e.g., see U.S. Pat. Nos. 5,039,392; 4,479,295; and 5,620,591 herein incorporated by reference).

The metal sulfide concentrate can be converted into catalyst concentrate by heating at 600 to 750° F. (315.56 to 398.89° C. for a time sufficient to form the catalyst. (e.g., see U.S. Pat. Nos. 5,039,392; 4,740,295; and 5,620,591). The catalyst of the concentrate consists of nano-scale metal sulfide sites distributed on a hydrocarbonaceous matrix that is derived from the oil component of the concentrate. Overall particle size can be varied, but falls within the range of 0.5 to 10 microns, preferably in the range of about 0.5 to 5.0 microns and, more preferably, 0.5 to 2.0 microns.

For the present process one may employ the precursor concentrate, the metal sulfide concentrate, or the catalyst concentrate. In each case, the petroleum feed is mixed with the concentrate to obtain the desired concentration of metal in the feed i.e., at least about 5 wppm, preferably about 10 to 1000 wppm. When the precursor or metal sulfide concentrates are used, catalyst having a particle size of about 0.5 to 10 microns, preferably 0.5 to 5 microns and most preferably 0.5 to 2.0 microns are formed in the heating step of the process in the TAN conversion reactor.

Preferred metals include molybdenum, tungsten, vanadium, iron, nickel, cobalt, and chromium. For example, heteropolyacids of the metals can be used. Molybdenum is particularly well suited to the process of the instant invention. Preferred molybdenum compounds are molybdenum naphthenates, dithiocarbamate complexes of molybdenum (e.g., see U.S. Pat. No. 4,561,964 incorporated herein by reference), phosphomolybdic acid and phosphorodithioate complexes of molybdenum (e.g. MOLYVANO® -L, molybdenum di(2-ethylhexyl) phosphorodithioate, supplied by R. T. Vanderbilt Company.

Other small particle catalysts that are useful for the practice of the instant process include metals-rich ash from the controlled combustion of petroleum coke (e.g., see U.S. Pat. Nos. 4,169,038; 4,178,227; and 4,204,943 herein incorporated by reference). Finely divided iron based materials, satisfying the particle size constraints noted herein, such as red mud from the processing of alumina can also be used.

Water vapor and carbon dioxide resulting from the decomposition of carboxylic acids act as inhibitors for the decomposition of remaining carboxylic acids. Water is a particularly strong inhibitor. Thus, if feed to the process contains water, a preflash step may be used to remove substantially all of the water. Moreover, trace amounts of water entering the process with the feed as well as water and carbon dioxide formed in the course of the destruction of carboxylic acids must be purged such that the partial pressure of water and carbon dioxides in the reaction zone is held below about 50 psia (about 344.75 kPa), preferably below about 30 psia (about 206.85 kPa), more preferably below about 20 psia (about 137.9 kPa) and, most preferably, below about 10 psia (about 68.95 kPa). Substantially all of the water as used herein means as much water as can be removed by methods known to those skilled in the art.

Though not wishing to be bound by theory, it appears that the source of water and carbon dioxide formation in this TAN destruction process can be described by the equations that follow. Reduction of carboxylic acids with hydrogen has the potential to yield up to two moles of water per mole of acid reduced (Equation A) or one mole of water per mole of acid reduced (Equation B). Thermal reactions, which can compete with reduction, yield one-half mole of water per mole of acid destroyed (Equation C).

Equation A $$RCHOOH + 2\,H_2 \cdots\rightarrow RCH_3 + 2\,H_2O$$

Equation B $$RCHOOH + H_2 \cdots\rightarrow RCH_2(OH)_2 \cdots\rightarrow H_2O + RCHO$$

$$RCHO \cdots\rightarrow RH\bullet + CO$$

Equation C

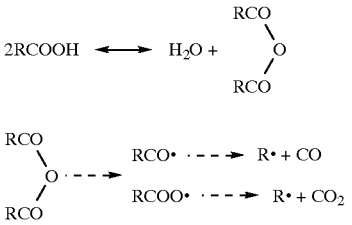

As will be illustrated in examples to follow, water can have a strong inhibiting effect on the rate of carboxylic acid destruction. Carbon dioxide is also an inhibitor but to a much lower degree.

To illustrate the potential for water pressure buildup resulting from destruction of carboxylic acids under conditions claimed for the process of the present invention, a hypothetical case was assumed where the TAN of a whole crude was lowered from 5.3 to 0.3 by thermal treating within the temperature range set forth in this invention, and that 1.25 moles of water were produced for each mole of acid that was destroyed. Calculated partial pressures for water are shown in FIG. 1 as a function of reactor pressure and sweep gas rate (i.e., hydrogen-containing gas). Note that water partial pressures as high as 72 psia (496.44 kPa) or greater can be obtained from acid decomposition alone, thus emphasizing the preference to start the process with a dry feed and to maintain a sweep gas rate to keep water pressure within specified levels.

From a process standpoint, the catalyst can be left in the treated crude (depending on the metal type and concentration) or removed by conventional means such as filtration.

Another aspect of the instant invention relates to the Conradson Carbon content of the product, i.e., the components of the product that yield coke under pyrolysis conditions. In thermal processes, such as Visbreaking, Conradson Carbon in the product is increased relative to that contained in the feed. This effect is illustrated in comparative Examples 5 of Table 2. Within the range of conditions for the process of the present invention, the growth or increase of Conradson Carbon can be totally inhibited and Conradson Carbon components can be converted to non-Comradson Carbon components. Preferably, Conradson Carbon conversion will range from about 0 to 5%, more preferably, from about from 5 to 20% and, most preferably, from 10 to 40%.

The following examples illustrate the invention, but are not meant to be limiting in any way.

Two feedstocks were used in this study (Table 1). One was a blend of Kome and Bolobo crudes from CHAD. The other was a Campo-1-Bare extra heavy crude from Venezuela. Both were heated to 230° F. (110° C.) with nitrogen purge to remove bulk water prior to use.

TABLE 1

| | Kome/Bolobo | Campo-1-Bare |
|---|---|---|
| TAN (Mg KOH/g CRUDE | 5.3 | 3.0 |
| Sulfur, wt % | 0.2 | 3.7 |
| Conradson Carbon, wt % | 7.6 | 16.3 |
| Vacuum Bottoms, wt % | 49 | 50.5 |
| API Gravity | 18 | 8.7 |
| Viscosity, cSt @ 104° F. (40° C.) | 1100 | 28,000 |

EXAMPLE#1

This example was calTied out in a 300 cc stilted autoclave reactor. The reactor was operated in a batch mode with respect to the crude that was charged. Hydrogen was flowed through the autoclave to maintain constant hydrogen partial pressure and to control the pressure of water and carbon dioxide in the reaction zone.

The reactor was charged with 100 g of the Kome/Bolobo blend and 0.61 g. of MOLYVAN®-L * (8.1 wt % Mo), flushed with hydrogen and then pressured to 350 psig (2514.58 kPa) with hydrogen at room temperature. Hydrogen flow was then started through the autoclave at a rate of 0.1 liter/min while maintaining a pressure of 350 psig (2514.58 kPa) by use of a backpressure regulator at the reactor outlet. The reactor was then heated to 625° F. (329.44° C.) with stilling and was held at 625° F. (329.44° C.) for 60 minutes at 350 psig (2514.58 kPa). The calculated partial pressures of hydrogen and water** were, respectively, 329 psia (2268.46 kPa) and 13 psia (89.64 kPa). Upon cooling to 250° F. (121.11° C.), the reactor was vented and flushed with hydrogen to recover light hydrocarbon products including hydrocarbons that are normally gaseous at room temperature. Reactor oil was then discharged, combined with liquid hydrocarbon removed when the reactor was vented and the blend was assayed for total acid number (TAN) using ASTM Method D-664, where TAN=mg KOH per gram of crude (or product oil). The measured TAN was 0.43.

* MOLYVAN®-L, supplied by the R.T. Vanderbilt Company, is molybdenum di(2-ethylhexyl) phosphorodithioate.

** Assumes maximum of 1.25 moles of water formed per mole of acid destroyed.

EXAMPLE#2 (Comparative)

This example illustrates the degree of TAN conversion obtained when Kome/Bolobo crude blend was heated at 625° F. (329.44° C.) for one hour in the absence of catalyst and hydrogen. The procedure of Example#1 was repeated except that MOLYVAN®-L was omitted and that the run was carried out with an inert gas sweep at a reactor pressure of 30 psig (308.18 kPa). TAN for the reactor product was 3.40.

Summary Of Examples With Kome/Bolobo Crude Blend

Example#1 illustrates destruction of TAN in Kome/Bolobo crude (Table 2) using a small amount of a highly dispersed catalyst at relatively mild conditions and with a water partial pressure in the reactor below 20 psia (137.9 kPa). Such treatment provides substantially greater TAN reduction than can be attained by thermal treatment alone at comparable time and temperature (Example#2).

TABLE 2

| EXAMPLE | 1 | 2 |
|---|---|---|
| Sweep Gas | Hydrogen | Inert Gas (He) |
| Mo, wppm | 491 | 0 |
| Temperature, ° F. | 625 (329.44° C.) | 625 (329.44° C.) |
| Reactor Pressure, psig | 350 (2413.2 kPa) | 30 (206.85 kPa) |
| Hydrogen Pressure, psia, Calculated | 337 (2323.6 kPa) | 0 (0 kPa) |
| Water, psia, Calculated | 13 (89.6 kPa) | <1 (<6.9 kPa) |
| Product TAN | 0.43 | 3.40 |

EXAMPLE#3

The feedstock used in this example was dry Campo-1-Bare crude. Mo was supplied as a catalyst precursor concentrate which was prepared in the following way. A solution of 8 g. of Fisher reagent grade phosphomolybdic acid was dissolved in 92 g. of deionized water. Next, 10 g. of solution was injected into 90 g. of Campo-1-Bare crude while stilling at 176° F. (80° C.) in a 300 cc Autoclave Engineer's Magnedrive Autoclave. After stilling for 10 minutes at 176° F. (80° C.), the autoclave was swept with nitrogen and the temperature increased to 300° F. (148.89° C.) to remove water. The resultant precursor concentrate contained 0.45 wt % Mo.

The autoclave was charged with 99.43 g. of dry Campo-1-Bare crude and 0.57 g of precursor concentrate to provide a reactor charge that contained 25 wppm Mo. The reactor was flushed with hydrogen and then pressured to 50 psig (446.08 kPa) with hydrogen sulfide. Upon heating with stifling for 10 minutes at 350 to 400° F. (176.67 to 204.44° C.), the reactor pressure was increased to 300 psig (2169.83 kPa) with hydrogen and a flow of hydrogen of 0.12 liters/min. (380 SCF/B) was started through the autoclave. Pressure was maintained by use of a backpressure regulator at the reactor gas-outlet line. Temperature was increased to 725° F. (385.00° C.) for a stirred reaction period of 120 minutes. Water partial pressure in the reactor was calculated to be 5.5 psia (37.92 kPa) (assumes 1.25 mole of water per mole of acid destroyed). The reactor was vented to atmospheric pressure while at 250° F. (121.11° C.), and oil remaining in the reactor was filtered at 180 to 200° F. (82.22 to 93.33° C.) to remove 0.03 g. of catalyst containing residue. Filtered reactor oil was combined with light liquids that were removed from the reactor during the course of the run and subsequent venting steps. The combined liquid products, which weighed 96.9 g., had a TAN of 0.10 (mg KOH/g. blend) and contained 15.9 wt % Conradson Carbon.

EXAMPLE#4

The procedures of Example#3 were repeated except that the run was carried out at a pressure of 400 psig (2859.33 kPa) and that water was fed to the reactor at the rate of 0.033 g/min. The partial pressure of water in the reactor during the run was about 92 psia (634.34 kPa). There were recovered 0.05 g. of catalyst containing residue, and 96.4 g. of product liquid blend that had a TAN of 0.43 and contained 15.4 wt % Conradson Carbon.

EXAMPLE#5 (Comparative)

The procedures of Example#4 were repeated except that catalyst was not added and that the experiment was carried out at 300 psig (2169.83 kPa) with argon as the sweep gas. There was recovered 97.4 g. of product liquid blend that had a TAN of 0.63 and contained 17.9 wt. % Conradson Carbon. Water partial pressure in the reactor was about 92 psia (634.34 kPa).

EXAMPLE#6

The procedures of Example#3 were repeated with the following changes. The reactor was charged with 98.86 g. of crude and 1.14 g. of precursor concentrate which provided a reactor charge that contained 50 wppm Mo. The run was carried out at 750° F. (398.89° C.) for 62 minutes at 300 psig (2169.83 kPa) with a hydrogen sweep of 0.12 liters/min. (380 SCF/B). Water was fed to the reactor at the rate of 0.017 g./min. to provide a water partial pressure in the reactor of 55 psia (379.22 kPa). There were recovered 0.05 g. of catalyst residue, and 97.3 g. of product liquid blend which had a TAN of 0.31, and contained 15.2 wt % Comnadson Carbon.

EXAMPLE#7

The procedures of Example#6 were repeated except that the sweep rate of hydrogen was 0.24 liters/min (780 SCF/B), which resulted in a water partial pressure in the reactor of 26 psia (179.27 kPa). There were recovered 0.04 g. of catalyst residue and 96.8 g. of product liquid blend which had a TAN of 0.12, contained 15.4 wt % Conradson Carbon and a kinematic viscosity of 918 centistokes at 104° F. (40° C.).

Summary Of Examples with Campo-1-Bare Crudes (Table 3)

Comparison of Example#3 with Example#4 illustrates the inhibiting effect of water on TAN conversion as does the comparison of Example#6 with Example#7, where a decrease in water partial pressure from 55 to 26 psia (379.22 to 179.27 kPa) reduced TAN from 0.31 to 0.12. Comparison of Example#4 with Example#5 illustrates that use of catalyst plus hydrogen, in accordance with the process of this invention, gives higher TAN conversion at a given water partial pressure than can be obtained by thermal treatment in the absence of hydrogen and catalyst.

TABLE 3

| Example No. | 3 | 4 | 5 | 6 | 7 |
|---|---|---|---|---|---|
| Sweep Rate, SCF/B | 380 | 380 | 380 | 380 | 780 |
| Water Pressure, psia (kPa) | 5.5 (37.92) | 92 (634.34) | 92 (634.34) | 55 (379.22) | 26 (179.27) |
| Hydrogen Pressure, psia (kPa) | 254 (1751.3) | 265 (1827.18) | 0 (0) | 259 (1785.80) | 260 (1792.7) |
| Liquid Product Blend | | | | | |
| TAN | 0.1 | 0.43 | 0.61 | .31 | 0.12 |
| Conradson Carbon, wt % | 15.9 | 15.4 | (17.9) | 15.2 | 15.4 |
| Vacuum Bottoms, Conversion % | 26.3 | 21.2 | 26.8 | 25.7 | 25.6 |

Corradson Carbon values were determined using the Micro Method, which is ASTM D 4530. This test determines the amount of carbon residue formed after evaporation and pyrolysis of petroleum materials under specified conditions. The test results are equivalent to those obtained using the Conradson Carbon Residue Test (Test Method D 189).

What is claimed is:

1. A method for reducing the amount of carboxylic acids in petroleum feeds comprising the steps of:

(a) adding to said petroleum feed a catalytic agent comprising an oil soluble or oil dispersible compound of a metal selected from the group consisting of Group VB, VIB, VIIB and VIII metals, wherein the amount of metal in said petroleum feed is at least about 5 wppm;

(b) heating said petroleum feed with said catalytic agent in a reactor at a temperature of about 400 to about 800° F. (about 204.44 to about 426.67° C.), under a hydrogen pressure of about 15 psig to about 1000 psig; (204.75 to 6996.33 kPa), and (c) sweeping the reactor containing said petroleum feed and said catalytic agent with hydrogen-containing gas to maintain the combined water and carbon dioxide partial pressure below about 50 psia (about 344.75 kPa).

2. The method of claim 1 wherein said catalytic agent comprises a catalyst precursor concentrate of an oil soluble or oil dispersible metal compound prepared in a petroleum feed selected from the group consisting of whole crudes, topped crudes, atmospheric resid, vacuum resid, vacuum gas oil, and mixtures thereof.

3. The method of claim 1 wherein said catalytic agent comprises a metal sulfide concentrate of an oil soluble or oil dispersible metal compound prepared in a petroleum feed selected from the group consisting of whole crudes, topped crudes, atmospheric resid, vacuum resid, vacuum gas oil, and mixtures thereof.

4. The method of claim 3 wherein metal sulfide concentrate is heated at a temperature and for a time sufficient to form a dispersion of 0.5 to 10 micron catalyst particles that comprise a metal sulfide component in association with a carbonaceous solid derived from said petroleum feed in which said metal sulfide is dispersed.

5. The method of claim 1 wherein said catalytic agent is a dispersion of 0.5 to 10 micron catalyst particles that comprise a metal sulfide component in association with a carbonaceous solid derived from said petroleum feed.

6. The method of claim 1 wherein said metal is selected from the group consisting of molybdenum, tungsten, vanadium, iron, nickel, cobalt, chromium, and mixtures thereof.

7. The method of claim 1 wherein said oil soluble or oil dispersible metal compound is a heteropolyacid of tungsten or molybdenum.

8. The method of claim 1 wherein said oil soluble or oil dispersible metal compound is selected from the group consisting of phosphomolybdic acid, molybdenum naphthenate, and molybdenum dialkyl phosphorodithioate.

9. The method of claim 1 wherein said petroleum feed comprises a whole crude, topped crude, vacuum residuum, atmospheric residuum, vacuum gas oil, or mixtures thereof.

10. The method of claim 1 wherein said carboxylic acid concentration is reduced by at least about 40%.

11. The method of claim 1 wherein the conversion of vacuum bottoms to lighter materials is less than about 40%.

12. The method of claim 1 wherein the combined partial pressure of water and carbon oxides is less than about 30 psia (about 206.85 kPa).

13. The method of claim 1 wherein water is substantially removed from the petroleum feed prior to said heating step.

14. The method of claim 2 wherein said catalyst precursor concentrate contains at least about 0.2 wt % metal.

15. The method of claim 3 wherein said metal sulfide concentrate contains at least about 0.2 wt % metal.

16. The method of claim 14 wherein said catalyst precursor concentrate contains at least about 0.2 to 2.0 wt % metal.

17. The method of claim 15 wherein said metal sulfide concentrate contains at least about 0.2 to 2.0 wt % metal.

18. The method of claim 4 wherein said metal sulfide concentrate is heated at temperatures of about 600 to about 750° F. (about 315.56 to about 398.89° C.).

19. The method of claim 1 wherein said catalytic agent is a metal rich ash from the controlled combustion of petroleum coke, or an iron-based-material from the processing of alumina.

20. The method of claim 1 wherein Conradson Carbon conversion to other materials is about 0 to 5%.

* * * * *